US012604982B2

(12) United States Patent
Zhao et al.

(10) Patent No.: US 12,604,982 B2
(45) Date of Patent: Apr. 21, 2026

(54) ELECTRIC SEAT MECHANICAL EXTENSION DEVICE AND ELECTRIC SEAT

(71) Applicant: Emomo Technology (Zhejiang) Co., Ltd., Huzhou (CN)

(72) Inventors: Yushu Zhao, Huzhou (CN); Wencai Li, Huzhou (CN); Kai Jin, Huzhou (CN)

(73) Assignee: Emomo Technology (Zhejiang) Co., Ltd., Huzhou (CN)

( * ) Notice: Subject to any disclaimer, the term of this patent is extended or adjusted under 35 U.S.C. 154(b) by 200 days.

(21) Appl. No.: 18/510,583

(22) Filed: Nov. 15, 2023

(65) Prior Publication Data

US 2025/0072610 A1 Mar. 6, 2025

(30) Foreign Application Priority Data

Aug. 28, 2023 (CN) ..... 202322314882.6

(51) Int. Cl.
*A47C 1/034* (2006.01)

(52) U.S. Cl.
CPC ..... *A47C 1/0345* (2013.01)

(58) Field of Classification Search
CPC ... A47C 1/0345; A47C 1/0342; A47C 7/5068; A47C 1/0355
See application file for complete search history.

(56) References Cited

U.S. PATENT DOCUMENTS

| | | | | |
|---|---|---|---|---|
| 4,937,900 | A * | 7/1990 | Bridges | A47C 1/0342 5/47 |
| 9,398,810 | B2 * | 7/2016 | Donovan | A47C 1/0342 |
| 9,433,294 | B2 * | 9/2016 | Donovan | A47C 7/5068 |
| 10,064,494 | B2 * | 9/2018 | Mackert | A47C 1/0345 |
| 10,376,060 | B2 * | 8/2019 | Marcantoni | A47C 1/0342 |
| 10,682,271 | B2 * | 6/2020 | Lin | A47C 7/5068 |
| 11,564,497 | B2 * | 1/2023 | Sha | A47C 1/03211 |
| 2005/0146167 | A1 * | 7/2005 | Tai | A47C 1/0345 297/85 L |

(Continued)

FOREIGN PATENT DOCUMENTS

| | | | | |
|---|---|---|---|---|
| CN | 112155356 | A * | 1/2021 | A47C 7/506 |
| CN | 112167864 | A * | 1/2021 | A47C 17/162 |

(Continued)

*Primary Examiner* — Timothy J Brindley
(74) *Attorney, Agent, or Firm* — Bayramoglu Law Offices LLC

(57) ABSTRACT

An electric seat mechanical extension device and an electric seat are provided. The electric seat mechanical extension device comprises two mechanical extending units which are bilaterally symmetrical with each other, each mechanical extending unit is composed of a seat frame support assembly, a leg assembly and a backrest bar, the two mechanical extending units are connected through a drive fixing assembly and a driving rod, a driving device is mounted on the drive fixing assembly, a head of the driving device is articulated with the driving rod, and the driving rod is connected with the leg assemblies; each seat frame support assembly is composed of a fixing rod and a transmission rod, the fixing rods are fixedly connected with the drive fixing assembly, front portions of the fixing rods are articulated with second leg links through second leg link and fixing rod articulation shafts.

6 Claims, 4 Drawing Sheets

(56) References Cited

U.S. PATENT DOCUMENTS

| | | | | |
|---|---|---|---|---|
| 2022/0361674 | A1* | 11/2022 | Li | A47C 1/0352 |
| 2024/0148145 | A1* | 5/2024 | Li | A47C 1/0355 |
| 2024/0164527 | A1* | 5/2024 | Li | A47C 7/5068 |
| 2024/0341478 | A1* | 10/2024 | Zhao | A47C 1/0345 |
| 2025/0000260 | A1* | 1/2025 | Cai | A47C 1/0355 |
| 2025/0040707 | A1* | 2/2025 | Cai | A47C 1/0242 |

FOREIGN PATENT DOCUMENTS

| | | | | | |
|---|---|---|---|---|---|
| CN | 112493740 | A | * | 3/2021 | A47C 1/03223 |
| CN | 213640252 | U | | 7/2021 | |
| CN | 113317651 | A | | 8/2021 | |
| CN | 217429591 | U | | 9/2022 | |
| CN | 218074230 | U | | 12/2022 | |
| CN | 115778130 | A | | 3/2023 | |
| CN | 220966847 | U | * | 5/2024 | A47C 1/035 |
| DE | 202016106474 | U1 | * | 11/2016 | A47C 1/0345 |
| DE | 202019106195 | U1 | * | 11/2019 | A47C 1/0345 |
| WO | WO-2025043760 | A1 | * | 3/2025 | A47C 1/0355 |

* cited by examiner

ELECTRIC SEAT MECHANICAL EXTENSION DEVICE AND ELECTRIC SEAT

CROSS REFERENCE TO THE RELATED APPLICATIONS

This application is based upon and claims priority to Chinese Patent Application No. 202322314882.6, filed on Aug. 28, 2023, the entire contents of which are incorporated herein by reference.

TECHNICAL FIELD

The application relates to an electric seat mechanical extension device and an electric seat, which are mainly used for position-adjustable electric seats.

BACKGROUND OF THE INVENTION

In prior art, electric seats are typically equipped with two motors, which are used for adjusting the position of leg assemblies and the position of backrest bars respectively. The electric seats have a relatively complex structure, a large number of parts, many production and installation steps, high material consumption, and higher production and maintenance costs.

BRIEF SUMMARY OF THE INVENTION

The technical issue to be settled by the application is to overcome the defects in the prior art by providing an electric seat mechanical extension device and an electric seat, which are simple in structure, convenient to produce, install and maintain, and low in cost.

One technical solution adopted by the application to settle the above technical issue is as follows: an electric seat mechanical extension device comprises two mechanical extending units which are bilaterally symmetrical with each other, each mechanical extending unit is composed of a seat frame support assembly, a leg assembly and a backrest bar, the two mechanical extending units are connected through a drive fixing assembly and a driving rod, a driving device is mounted on the drive fixing assembly, a head of the driving device is articulated with the driving rod, and the driving rod is connected with the leg assemblies; the electric seat mechanical extension device is characterized in that each seat frame support assembly is composed of a fixing rod and a transmission rod, the fixing rods are fixedly connected with the drive fixing assembly, front portions of the fixing rods are articulated with second leg links through second leg link and fixing rod articulation shafts, rear portions of the fixing rods are articulated with the backrest bars through fixing rod and backrest bar articulation shafts, backrest lying position retainers are arranged on the backrest bars, and lower portions of the backrest bars are articulated with rear ends of the transmission rods through transmission rod and backrest bar articulation shafts. In the application, a quadrilateral support structure of the seat is formed by the upper half of the fixing rods, the transmission rods and the second leg links and the lower half of the backrest bars, the process is simplified, the number of parts is reduced, installation, maintenance and debugging steps are reduced, position adjustment of the leg assemblies and the backrest bars can be realized through one driving device, and the cost is saved.

Each leg assembly is composed of a first leg link, a second leg link, a third leg link, a fourth leg link and a footrest, wherein the driving rod is fixedly connected with the first leg link, one end of the first leg link is articulated with the fixing rod, the other end of the first leg link is articulated with one end of the third leg link, the other end of the third leg link is articulated with one end of the footrest, the other end of the footrest is articulated with one end of the fourth leg link, the middle of the fourth leg link is articulated with the first leg link, the other end of the fourth leg link is articulated with one end of the second leg link, and the other end of the second leg link is articulated with the fixing rod through the second leg link and fixing rod articulation shaft.

Leg assembly retainers are arranged on the footrests, and in a lying position, the leg assembly retainers abut against the third leg links to limit the leg assemblies; and in a sitting position, the leg assembly retainers abut against the fourth leg links to limit the leg assemblies.

Only one driving device is adopted, and position adjustment of the leg assemblies and the backrest bars is realized through the only one driving device.

Another technical solution adopted by the application to settle the above technical issue is as follows: an electric seat comprises the electric seat mechanical extension device, a driving device and a chassis, wherein the electric seat mechanical extension device is mounted on the chassis through a rotating shaft. Users can adjust the direction of the seat conveniently by rotation The rotating shaft is rotatably mounted in the middle of the drive fixing assembly.

Compared with the prior art, the application has the following advantages and effects: the structure is simple, production, installation and maintenance are convenient, position adjustment of the leg assemblies and the backrest bars can be realized by means of only one driving device, and the cost is low.

1, drive fixing assembly; 2, driving rod; 3, leg assembly; 31, first leg link; 32, second leg link; 3241, second leg link and fixing rod articulation shaft; 3242, second leg link and transmission rod articulation shaft; 33, third leg link; 34, fourth leg link; 35, footrest; 351, leg assembly retainer; 4, seat frame support assembly; 41, fixing rod; 415, fixing rod and backrest bar articulation shaft; 42, transmission rod; 425, transmission rod and backrest bar articulation shaft; 5, backrest bar; 51, backrest lying position retainer; 6, rotating shaft; 7, chassis; 8, driving device.

DETAILED DESCRIPTION OF THE INVENTION

Figure 2:
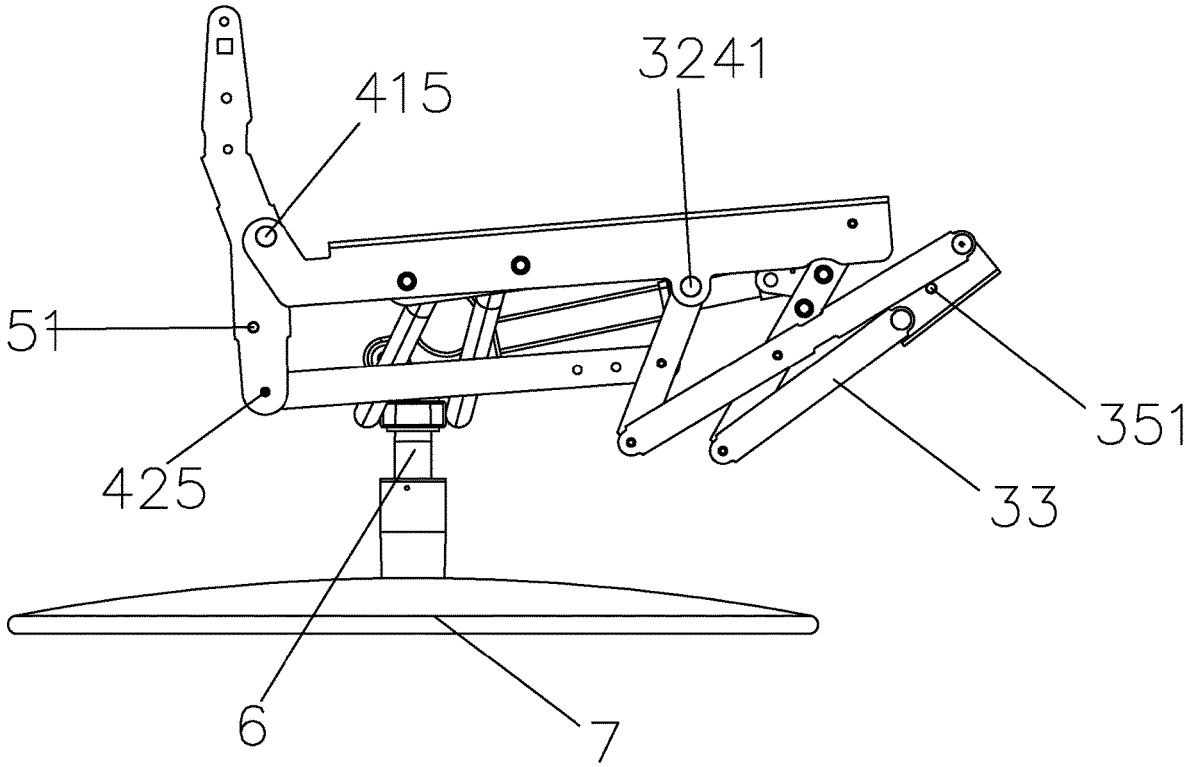
FIG. 2 is a side view of the electric seat in the sitting position according to one embodiment of the application.

The application will be described in further detail below in conjunction with accompanying drawings and embodiments. The following embodiments are merely used for explaining the application, and are not intended to limit the application. In the application, the right of FIG. 2 is the front side, and the left of FIG. 2 is the back side.

Referring to FIG. 1-FIG. 4, one embodiment of the application provides an electric seat mechanical extension device comprising two mechanical extending units which are bilaterally symmetrical with each other, each mechanical extending unit is composed of a seat frame support assembly 4, a leg assembly 3 and a backrest bar 5, the two mechanical extending units are connected through a drive fixing assembly 1 and a driving rod 2, a driving device 8 is mounted on the drive fixing assembly 1, a head of the driving device is articulated with the driving rod 2, and the driving rod 2 is connected with the leg assemblies 3; the electric seat mechanical extension device is characterized in that each seat frame support assembly 4 is composed of a fixing rod 41 and a transmission rod 42, the fixing rods 41 are fixedly connected with the drive fixing assembly 1, front portions of the fixing rods 41 are articulated with second leg links 32 through second leg link and fixing rod articulation shafts 3241, rear portions of the fixing rods are articulated with the backrest bars 5 through fixing rod and backrest bar articulation shafts 415, backrest lying position retainers 51 are arranged on the backrest bars 5, and lower portions of the backrest bars 5 are articulated with rear ends of the transmission rods 42 through transmission rod and backrest bar articulation shafts 425; and position adjustment of the leg assemblies 3 and t the backrest bars 5 can be realized through one driving device 8. In the application, a quadrilateral support structure of a seat is formed by the upper half of the fixing rods 41, the transmission rods 42 and the second leg links 32 and the lower half of the backrest bars 5, the process is simplified, the number of parts is reduced, installation, maintenance and debugging steps are reduced, position adjustment of the leg assemblies 3 and the backrest bars 5 can be realized through one driving device 8, and the cost is saved.

In the application, each leg assembly 3 is composed of a first leg link 31, a second leg link 32, a third leg link 33, a fourth leg link 34 and a footrest 35, wherein the driving rod 2 is fixedly connected with the first leg link 31, one end of the first leg link 31 is articulated with the fixing rod 41, the other end of the first leg link 31 is articulated with one end of the third leg link 33, the other end of the third leg link 33 is articulated with one end of the footrest 35, the other end of the footrest 35 is articulated with one end of the fourth leg link 34, the middle of the fourth leg link 34 is articulated with the first leg link 31, the other end of the fourth leg link 34 is articulated with one end of the second leg link 32, and the other end of the second leg link 32 is articulated with the fixing rod 41 through the second leg link and fixing rod articulation shaft 3241.

Figure 1:
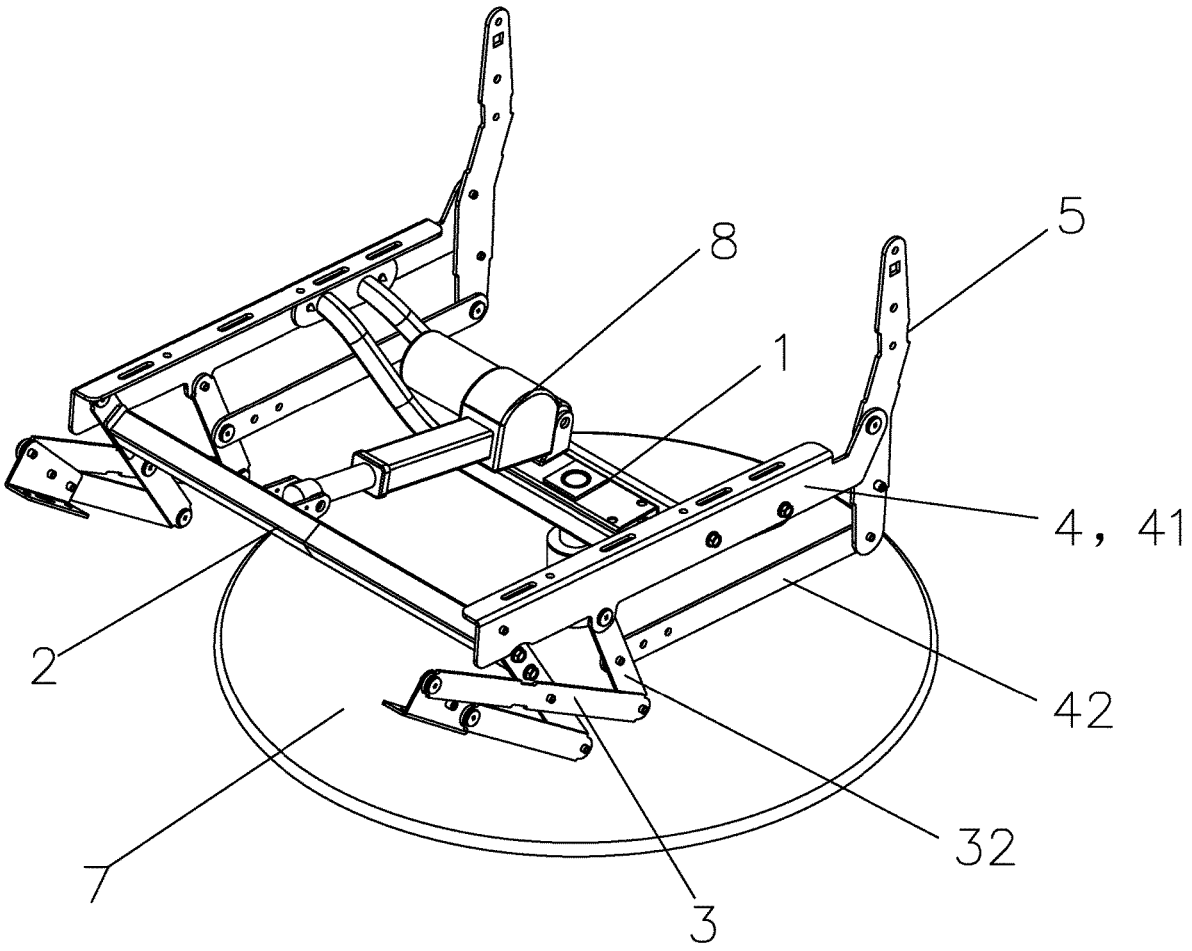
FIG. 1 is a three-dimensional view of an electric seat in a sitting position according to one embodiment of the application.
Figure 3:
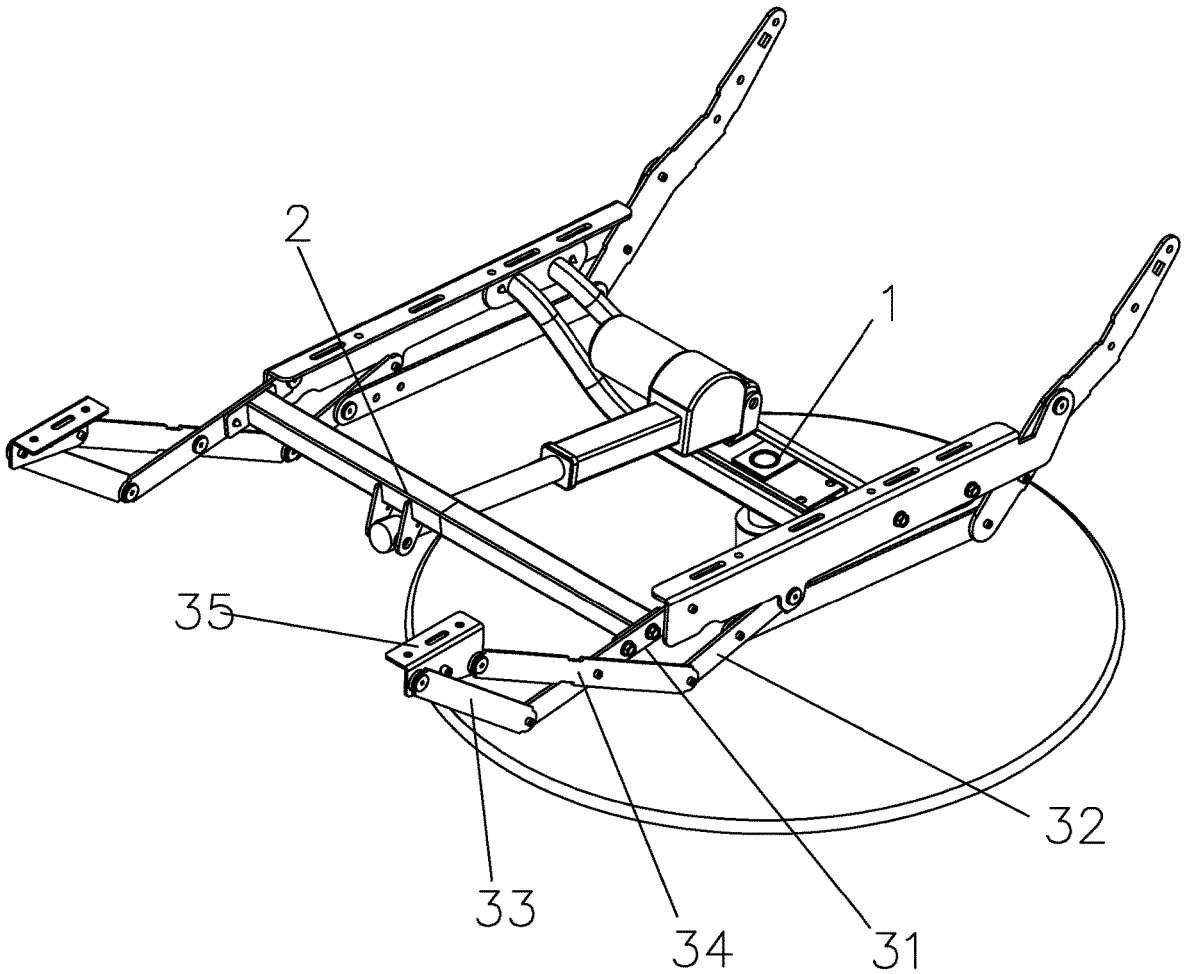
FIG. 3 is a three-dimensional view of the electric seat in a lying position according to one embodiment of the application.
Figure 4:
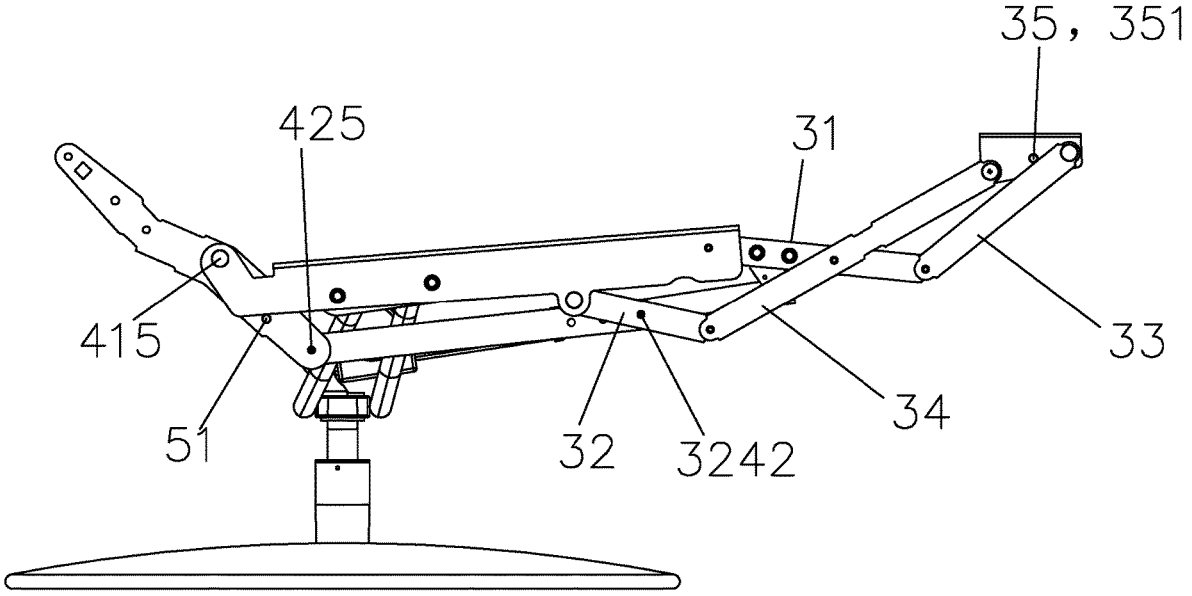
FIG. 4 is a side view of the electric seat in the lying position according to one embodiment of the application.

The position adjustment process of the electric seat mechanical extension device in this embodiment of the application is as follows:

When the electric seat mechanical extension device needs to be switched from a sitting position to a lying position, the head of the driving device 8 moves forward to drive the first leg links 31 to rotate forward through the driving rod 2, the third leg links 33 and the fourth leg links 34 connected with the first leg links 31 are driven to act correspondingly and drive the footrests 35 and the second leg links 32 connected with the third leg links 33 and the fourth leg links 34 to act correspondingly, and the second leg links 32 move forward to drive the lower ends of backrest bars 5 to move forward, such that the upper ends of the backrest bars 5 rotate backward and downward around the fixing rod and backrest bar articulation shafts 415, and when the backrest bars 5 abut against the backrest lying position retainers 51, the electric seat mechanical extension device is switched to the lying position, as shown in FIG. 3 and FIG. 4; and at this moment, leg assembly retainers 351 abut against the third leg links 33, such that the leg assemblies 3 are limited. When the electric seat mechanical extension device needs to be switched back to the sitting position, the head of the driving device 8 moves backward, the leg assemblies 3 are driven to move backward correspondingly, the upper ends of the backrest bars 5 rotate upward and forward, and when the leg assembly retainers 351 abut against the fourth leg links 34, the electric seat mechanical extension device is switched to the sitting position, as shown in FIG. 1 and FIG. 2.

The electric seat mechanical extension device is mounted on a chassis 7 through a rotating shaft 6, then the driving device 8 is mounted on the electric seat mechanical extension device to form a rotatable electric seat, and the driving device 8 may be an electric push rod capable of realizing front-and-back driving.

Those that are not described in the application belong to the prior art, and will not be detailed anymore.

What is claimed is:

1. An electric seat mechanical extension device, comprising two mechanical extending units bilaterally symmetrical with each other, wherein each of the two mechanical extending units is composed of a seat frame support assembly, a leg assembly and a backrest bar, the two mechanical extending units are connected through a drive fixing assembly and a driving rod, a driving device is mounted on the drive fixing assembly, a head of the driving device is articulated with the driving rod, and the driving rod is connected with the leg assemblies, wherein the seat frame support assembly is composed of a fixing rod and a transmission rod, the fixing rods are fixedly connected with the drive fixing assembly, front portions of the fixing rods are articulated with second leg links through second leg link and fixing rod articulation shafts, rear portions of the fixing rods are articulated with the backrest bars through fixing rod and backrest bar articulation shafts, backrest lying position retainers are arranged on the backrest bars, and lower portions of the backrest bars are articulated with rear ends of the transmission rods through transmission rod and backrest bar articulation shafts.

2. The electric seat mechanical extension device according to claim 1, wherein the leg assembly is composed of a first leg link, a second leg link, a third leg link, a fourth leg link and a footrest, the driving rod is fixedly connected with the first leg link, a first end of the first leg link is articulated with the fixing rod, a second end of the first leg link is articulated with a first end of the third leg link, a second end of the third leg link is articulated with a first end of the footrest, a second end of the footrest is articulated with a first end of the fourth leg link, a middle of the fourth leg link is articulated with the first leg link, a second end of the fourth leg link is articulated with a first end of the second leg link, and a second end of the second leg link is articulated with the fixing rod through the second leg link and fixing rod articulation shaft.

3. The electric seat mechanical extension device according to claim 2, wherein leg assembly retainers are arranged on the footrests, and in a lying position, the leg assembly retainers abut against the third leg links to limit the leg assemblies; and in a sitting position, the leg assembly retainers abut against the fourth leg links to limit the leg assemblies.

4. The electric seat mechanical extension device according to claim 1, wherein only one driving device is adopted, and position adjustment of the leg assemblies and the backrest bars is realized through the only one driving device.

5. An electric seat, comprising:

the electric seat mechanical extension device according to claim 4, a driving device and a chassis, wherein the electric seat mechanical extension device is mounted on the chassis through a rotating shaft.

6. The electric seat according to claim 5, wherein the rotating shaft is rotatably mounted in a middle of the drive fixing assembly.

* * * * *